US010186818B2

(12) United States Patent
Zhu

(10) Patent No.: US 10,186,818 B2
(45) Date of Patent: Jan. 22, 2019

(54) STRAIGHT INSERTION SELF-LOCKING ANTI-EXPLOSION ELECTRICAL CONNECTION DEVICE, AND PLUG AND SOCKET THEREOF

(71) Applicant: Zhaoyong Zhu, Zhenjiang (CN)

(72) Inventor: Zhaoyong Zhu, Zhenjiang (CN)

( * ) Notice: Subject to any disclaimer, the term of this patent is extended or adjusted under 35 U.S.C. 154(b) by 0 days.

(21) Appl. No.: 15/575,506

(22) PCT Filed: May 13, 2016

(86) PCT No.: PCT/CN2016/082028
§ 371 (c)(1),
(2) Date: Nov. 20, 2017

(87) PCT Pub. No.: WO2016/188333
PCT Pub. Date: Dec. 1, 2016

(65) Prior Publication Data

US 2018/0159285 A1 Jun. 7, 2018

(30) Foreign Application Priority Data

May 22, 2015 (CN) ..... 2015 1 0268391

(51) Int. Cl.

| | |
|---|---|
| ***H01R 13/64*** | (2006.01) |
| ***H01R 13/41*** | (2006.01) |
| ***H01R 13/453*** | (2006.01) |
| ***H01R 13/02*** | (2006.01) |
| ***H01R 24/86*** | (2011.01) |
| ***H01R 13/627*** | (2006.01) |

(Continued)

(52) U.S. Cl.
CPC ..... *H01R 24/86* (2013.01); *H01R 13/02* (2013.01); *H01R 13/41* (2013.01); *H01R 13/4538* (2013.01); *H01R 13/6276* (2013.01); *H01R 13/64* (2013.01); *H01R 24/76* (2013.01); *H01R 2103/00* (2013.01)

(58) Field of Classification Search
CPC .... H01R 13/6276; H01R 13/64; H01R 24/76; H01R 13/41; H01R 13/4538; H01R 2303/00
See application file for complete search history.

(56) References Cited

FOREIGN PATENT DOCUMENTS

| | | | |
|---|---|---|---|
| CN | 201365022 Y | * | 12/2009 |
| CN | 202259942 U | * | 5/2012 |

* cited by examiner

*Primary Examiner* — Briggitte R Hammond
(74) *Attorney, Agent, or Firm* — Li & Cai Intellectual Property (USA) Office

(57) ABSTRACT

A straight insertion self-locking anti-explosion electrical connection device, and a plug and a socket thereof relate to the field of conductive connection devices. The plug has a plugging bolt. The plugging bolt has two or more plug power supply electrodes and a plug grounding electrode. The side wall of the plugging bolt has a plug self-locking portion, and the plug self-locking portion is a circular hole, or a recessed groove and a recessed point having a curved surface structure. The socket has a jack, and the wall of the jack has two or more socket power supply electrodes and a socket grounding electrode. The wall of the jack has socket self-locking portions, and each socket self-locking portion has a clamping and locking member having a raised or recessed curved surface structure or a circular hole. Corresponding electrodes of the plug and the socket are mutually paralleling inclined planes.

14 Claims, 7 Drawing Sheets

(51) Int. Cl.

| | |
|---|---|
| *H01R 103/00* | (2006.01) |
| *H01R 24/76* | (2011.01) |

STRAIGHT INSERTION SELF-LOCKING ANTI-EXPLOSION ELECTRICAL CONNECTION DEVICE, AND PLUG AND SOCKET THEREOF

TECHNICAL FIELD

The present invention relates to an electrical connection device, and a plug and a socket thereof; and in particular, to a straight insertion self-locking anti-explosion electrical connection device, and a plug and a socket thereof.

BACKGROUND

Conventional electrical connection devices generally adopt a direct insertion manner, for example, using common two-hole or three-hole sockets and corresponding plugs. Power is on when a plug is inserted into a socket, while power is off when the plug is pulled out of the socket. This conventional electrical connection manner is convenient in use. However, the electrical connection in this manner completely depends on contact between metal contacts that press against each other, as well as conductivity of the metal contacts. The metal contacts need to have both a conductive function and a fastening function. In an actual application, a loose connection or a bad connection usually occurs, resulting in poor reliability of an electrical connection. Moreover, such an electrical connection manner easily causes an electric spark during insertion or pullout of the plug, and even incurs an electrical accident in a serious case. In addition, metal contacts of a conventional plug expose relatively long, which not only wastes materials, but also causes safety threats such as an electric shock; besides, the relatively long metal contacts are easily bent during conveyance, which affects the normal use.

To eliminate the foregoing defects of unsafe and unreliable electrical connection between the conventional straight insertion type plugs and sockets, some novel plugs and sockets emerge in the market, which also change the existing electrical connection manner. Especially for rotary plugs and sockets, generally, a circular plug having metal contacts on its outer wall is inserted into a socket with a circular hole, and is rotated by 90° to enable connection between the contacts of the plug and the socket. There are generally two situations when the plug is pulled out of the socket. In a first situation, the plug is rotated counterclockwise to pop out of the socket. However, such a pullout manner has a low power-off speed and results in certain safety threats in the case of an emergency. In a second situation, the plug can be pulled out directly. This manner ensures electrical safety. However, most users exert a small force when trying to directly pull out the plug, and may easily have a feeling that the plug cannot be directly pulled out. As a result, the users still adopt the counterclockwise rotation manner to cut off the power. Moreover, this manner of directly pulling out the plug requires a large force, which may cause large damages to the plug and the socket and affect their service life. Besides, the following situation usually occurs during use of such a rotary socket: when one user inserts a plug into a socket, another user may not know that this socket is a rotary socket and has difficulty in cutting off the power. In addition, the rotary socket has a defect that the plug is easily rotated counterclockwise in use under a tiny external force, and as a result, the metal contacts have poor contact stability and an unexpected power outage easily occurs. Therefore, the users often feel that it is inconvenient to use the rotary plugs, and thus such plugs and sockets are received unfavorably in the market.

With reference to advantages of the conventional straight insertion type plugs and sockets and advantages of the rotary plugs and sockets, novel straight insertion type plugs and sockets emerge in the market, which have structures similar to those of the rotary plugs and sockets and enable direct insertion and pullout. However, for such a plug and a socket, a single-side locking slot and a locking plate are used to fasten the plug, and a locking device is needed to work in cooperation to implement locking or unlocking, so that the operation is still rather complicated. In addition, under a single-side force from the locking device, a gap easily occurs between contacts of the plug and the socket, resulting in poor stability of the electrical connection and severe heat emission of the contacts.

SUMMARY OF THE INVENTION

1. Technical Problems to be Solved by the Present Invention

Objectives of the present invention are to eliminate the defects of an existing straight insertion lockable electrical connection manner that the operation is complicated and the electrical connection has poor stability; and provide a straight insertion self-locking anti-explosion electrical connection device, and a plug and a socket thereof. In the technical solutions of the present invention, an inserted plug is fastened through cooperation between socket self-locking portions and plug self-locking portions that have simple structures, and instant and stable electrical contact is achieved by using metal contacts having parallel inclined surfaces, thus avoiding occurrence of an electric spark, ensuring the largest contact area between electrodes, lowering heat emission during power connection, and increasing an upper limit value of a passing current. The plug can be pulled out directly against a force from a self-locking structure, and can be disconnected conveniently and rapidly. The metal contacts are also completely separated from each other instantly without causing an electric spark, such that the device is truly anti-explosion and is safe and reliable.

2. Technical Solutions

To achieve the foregoing objectives, the present invention provides the following technical solutions:

The present invention provides a straight insertion self-locking anti-explosion electrical connection device, including a plug and a socket adapted to the plug, where the plug is provided with a plugging bolt, the plugging bolt is provided with two or more plug power supply electrodes and a plug grounding electrode, a side wall of the plugging bolt is further provided with one or more plug self-locking portions, the plug self-locking portion being a circular hole, or a groove or a bump with a curved surface structure, and an orientation positioning hole is further provided on the plugging bolt in an insertion direction; the socket is provided with a jack adapted to the plugging bolt, a wall of the jack is provided with two or more socket power supply electrodes and a socket grounding electrode that respectively correspond to the plug power supply electrodes and the plug grounding electrode; the wall of the jack is further provided with socket self-locking portions corresponding to the plug self-locking portions, each socket self-locking portion is provided with a clamping and locking member having a convex or concave surface structure or a circular hole, the locking member matches with the plug self-locking portion, and an orientation positioning pillar matching with the orientation positioning hole is further provided in the jack; and the plug is directly inserted into the jack of the socket with the plugging bolt, and is fastened through cooperation between the socket self-locking portions in the socket and the plug self-locking portions on the plug, the plug power supply electrodes and the plug grounding electrode on the plug respectively and correspondingly contact the socket power supply electrodes and the socket grounding electrode in the socket sufficiently to enable power connection, and the plug is pulled out for disconnection against a fastening force from the socket self-locking portions under an external force in a direction opposite to the insertion direction.

Furthermore, the plugging bolt is formed by a first plugging pillar and a second plugging pillar with outline dimensions descending along the insertion direction; the plug grounding electrode is provided on a side surface of the first plugging pillar, the plug power supply electrodes are provided on side surfaces of the second plugging pillar, and the plug self-locking portion is provided on a side surface of the first plugging pillar.

Furthermore, the curved surface structures of the plug self-locking portion and the locking member are of hemispherical shapes with identical radiuses.

Furthermore, two opposite plug self-locking portions are disposed.

Furthermore, contact surfaces of the plug power supply electrodes on the plugging bolt are of inclined surface structures, contact surfaces of the socket power supply electrodes in the jack are also of inclined surface structures, and the inclined surfaces of the plug power supply electrodes are parallel to the inclined surfaces of the corresponding socket power supply electrodes.

Furthermore, a contact surface of the plug grounding electrode on the plugging bolt is of an inclined surface structure, a contact surface of the socket grounding electrode in the jack is also of an inclined surface structure, and the inclined surface of the plug grounding electrode is parallel to the inclined surface of the socket grounding electrode.

Furthermore, the socket has a housing and a socket substrate, the housing is provided on the socket substrate; two power supply electrode mounting positions, two socket self-locking portion mounting positions, one grounding electrode mounting position, and one wiring position are provided inside the socket substrate, the two power supply electrode mounting positions being oppositely disposed, and the two socket self-locking portion mounting positions also being oppositely disposed; alternatively, three power supply electrode mounting positions, two socket self-locking portion mounting positions, one grounding electrode mounting position, and one wiring position are provided inside the socket substrate, two of the three power supply electrode mounting positions being oppositely disposed and the other one being disposed in a direction perpendicular to a connecting line between the two opposite power supply electrode mounting positions, and the two socket self-locking portion mounting positions being oppositely disposed; and the socket power supply electrodes, the socket self-locking portions, and the socket grounding electrode are respectively and correspondingly mounted in the power supply electrode mounting positions, the socket self-locking portion mounting positions, and the grounding electrode mounting position.

Furthermore, the socket further includes a floating support cover sleeved on the orientation positioning pillar, a support spring is disposed below the floating support cover, and the floating support cover is limited at the jack by the housing and is capable of moving on the orientation positioning pillar with insertion or pullout of the plug.

Furthermore, a rib plate that firmly fits the plugging bolt is provided around the jack.

Furthermore, the socket self-locking portion includes a fixed base, a taper sleeve, a locking member, a self-locking spring, and an insert plate, the fixed base is mounted on the socket substrate, the taper sleeve is embedded in a mounting hole of the fixed base, the locking member is disposed in the taper sleeve, a front portion of the locking member is limited by a front-end taper angle of the taper sleeve and a rear portion thereof is tightly pressed by the self-locking spring, and a rear end of the self-locking spring presses against the insert plate that is inserted into a rear end of the fixed base.

Furthermore, the fixed base is further provided with a positioning slot, and the positioning slot matches with a positioning pillar provided on the socket substrate to implement positioning.

Furthermore, the socket power supply electrode includes an electrode mounting seat, a power supply electrode contact, and a power supply electrode push spring, the electrode mounting seat is mounted in a slide slot provided on the socket substrate, and matches with travel limiting slots disposed at two sides of the slide slot by using barrier blocks provided at two sides of the electrode mounting seat; the power supply electrode contact is fitly inserted, through a clamping slot provided on a side of the contact, on a positioning protrusion provided at a front end of the electrode mounting seat; a withdrawal prevention hook for preventing the power supply electrode contact from withdrawing is provided on an upper end of the positioning protrusion; a rear end of the electrode mounting seat is provided with a spring fixing pillar; and the power supply electrode push spring is sleeved on the spring fixing pillar.

Furthermore, the socket grounding electrode includes a contact positioning pillar, a grounding electrode contact, and a grounding electrode push spring, a rear portion of the contact positioning pillar is inserted on the socket substrate by using a fixer; the grounding electrode contact has a block-shaped structure with an inclined surface, is provided with a mounting hole at a rear end, and is mounted on the contact positioning pillar through the mounting hole; the grounding electrode push spring is sleeved on the contact positioning pillar, and is located between the fixer of the contact positioning pillar and the grounding electrode contact; and a stopper for a limiting purpose is further provided on a side of the grounding electrode contact.

The present invention provides a plug including a plugging bolt, where the plugging bolt is provided with two or more plug power supply electrodes and a plug grounding electrode, a side wall of the plugging bolt is further provided with one or more plug self-locking portions, the plug self-locking portion being a circular hole, or a groove or a bump with a curved surface structure and matching with a locking member provided on a socket, and an orientation positioning hole is further provided on the plugging bolt in an insertion direction.

Furthermore, the plugging bolt is formed by a first plugging pillar and a second plugging pillar with outline dimensions descending along the insertion direction; the plug grounding electrode is provided on a side surface of the first plugging pillar, the plug power supply electrodes are provided on side surfaces of the second plugging pillar, and the plug self-locking portion is provided on a side surface of the first plugging pillar.

Furthermore, the curved surface structure of the plug self-locking portion is of a hemispherical shape, and two opposite plug self-locking portions are disposed on the first plugging pillar.

Furthermore, contact surfaces of the plug power supply electrodes on the plugging bolt are of inclined surface structures, and the inclined surfaces of the plug power supply electrodes are parallel to inclined surfaces of corresponding power supply electrodes on the socket; a contact surface of the plug grounding electrode on the plugging bolt is also of an inclined surface structure, and the inclined surface of the plug grounding electrode is parallel to an inclined surface of a corresponding grounding electrode on the socket.

Furthermore, a dustproof and waterproof protective cover is further sleeved on the plugging bolt.

The present invention provides a socket including a jack, where a wall of the jack is provided with two or more socket power supply electrodes and a socket grounding electrode, and is further provided with one or more socket self-locking portions; the socket self-locking portion is used to achieve a self-locking effect together with a plug self-locking portion on a plug, each socket self-locking portion is provided with a clamping and locking member having a convex or concave surface structure or a circular hole, and the locking member matches with the plug self-locking portion provided on the plug; and an orientation positioning pillar is further provided in the jack.

Furthermore, two opposite socket self-locking portions are disposed on the wall of the jack, and the curved surface structure of the locking member is of a hemispherical shape.

Furthermore, contact surfaces of the socket power supply electrodes in the jack are of inclined surface structures, and the inclined surfaces of the socket power supply electrodes are parallel to inclined surfaces of corresponding power supply electrodes on the plug; a contact surface of the socket grounding electrode in the jack is also of an inclined surface structure, and the inclined surface of the socket grounding electrode is parallel to an inclined surface of a corresponding grounding electrode on the plug.

Furthermore, the socket has a housing and a socket substrate, where the housing is provided on the socket substrate, the jack is provided on a middle portion of the housing, and an edge of the jack is provided with a notch; two power supply electrode mounting positions, two socket self-locking portion mounting positions, one grounding electrode mounting position, and one wiring position are provided inside the socket substrate, the two power supply electrode mounting positions being oppositely disposed, and the two socket self-locking portion mounting positions also being oppositely disposed; alternatively, three power supply electrode mounting positions, two socket self-locking portion mounting positions, one grounding electrode mounting position, and one wiring position are provided inside the socket substrate, two of the three power supply electrode mounting positions being oppositely disposed and the other one being disposed in a direction perpendicular to a connecting line between the two opposite power supply electrode mounting positions, and the two socket self-locking portion mounting positions being oppositely disposed; the socket power supply electrodes, the socket self-locking portions, and the socket grounding electrode are respectively and correspondingly mounted in the power supply electrode mounting positions, the socket self-locking portion mounting positions, and the grounding electrode mounting position; and the socket self-locking portions are fixed above the socket power supply electrodes.

Furthermore, the socket further includes a floating support cover sleeved on the orientation positioning pillar, a support spring is disposed below the floating support cover, and the floating support cover is limited at the jack by the housing and is capable of moving on the orientation positioning pillar with insertion or pullout of the plug.

Furthermore, a rib plate that firmly fits the plugging bolt is provided around the jack.

3. Beneficial Effects

Compared with the prior art, the technical solutions of the present invention have the following remarkable effects:

(1) The present invention provides a straight insertion self-locking anti-explosion electrical connection device, including a plug provided with plug self-locking portions and an orientation positioning hole, and a socket provided with socket self-locking portions and an orientation positioning pillar. Electrode contacts of the plug and the socket have parallel inclined surfaces. The plug is directly inserted into a jack of the socket with a plugging bolt, and is fastened through cooperation between the socket self-locking portions in the socket and the plug self-locking portions on the plug. The plug is pulled out for disconnection against a fastening force from the socket self-locking portions under an external force in a direction opposite to an insertion direction. The plug inserted into the socket is fastened through cooperation between the socket self-locking portions and the plug self-locking portions that have simple structures, and instant and stable electrical contact is achieved by using metal contacts having parallel inclined surfaces, thus avoiding occurrence of an electric spark, ensuring the largest contact area between electrodes, lowering heat emission during power connection, and increasing an upper limit value of a passing current. The plug can be pulled out directly against a force from a self-locking structure, and can be disconnected conveniently and rapidly. The metal contacts are also completely separated from each other instantly without causing an electric spark, such that the device is truly anti-explosion, enables direct insertion and pullout, and is safe and reliable. The orientation positioning pillar and the orientation positioning hole precisely match with each other, such that the plug and the socket are accurately positioned and not easily get loose, thus ensuring sufficient contact between the metal contacts. In addition, the plug can be pulled out only under a force of certain magnitude in a direction opposite to the insertion direction, thus implementing rapid disconnection. In a stable fastening and attaching system formed by a self-locking device, an orientation positioning pillar, an orientation rib plate around the jack, and parallel inclined surfaces of electrodes, the plug may not get loose or fall off under an external force in other directions, thus achieving a highly reliable connection. Moreover, compared with a rotary socket, electrode contacts of the plug and the socket are not limited by structures, and can be made larger to increase the contact area of the electrodes, thus raising the power.

(2) In the straight insertion self-locking anti-explosion electrical connection device of the present invention, the plugging bolt is formed by a first plugging pillar and a second plugging pillar with outline dimensions descending along the insertion direction. A plug grounding electrode is provided on a side surface of the first plugging pillar, plug power supply electrodes are provided on side surfaces of the second plugging pillar, and the plug self-locking portion is provided on a side surface of the first plugging pillar. The plug grounding electrode is disposed on a portion of the plugging bolt near the outside, such that a large distance is formed between the electrodes to prevent the electrodes from affecting each other. In addition, compared with a rotary plug, the plug grounding electrode is arranged above the plug power supply electrodes, and therefore can first contact an electrode in the socket when the plug is directly inserted into the socket. Thus, an electrical connection requirement is met, and personal safety is ensured in the case of an electrical accident.

(3) In the straight insertion self-locking anti-explosion electrical connection device of the present invention, curved surface structures of the plug self-locking portion and a locking member are of hemispherical shapes with identical radiuses. When the plug is inserted into the socket, the plug self-locking portion and the locking member can be smoothly engaged. The plug may not pop out without an external force. When an outward pulling force is applied to the plug, the plug can be easily pulled out through cooperation between the locking member and the plug self-locking portion, which facilitates use and achieves rapid disconnection. In addition, during insertion of the plug, the plug naturally moves into the socket because of the curved surface structures of the plug self-locking portion and the socket self-locking portion, such that contacts having inclined surfaces can completely contact each other in an instant.

(4) In the straight insertion self-locking anti-explosion electrical connection device of the present invention, two opposite plug self-locking portions are disposed. Consequently, the plug receives balanced forces and may not tilt after being inserted into the socket. The metal contacts contact each other more closely and stably, thus ensuring desirable performance of the electrical connection.

(5) In the straight insertion self-locking anti-explosion electrical connection device of the present invention, contact surfaces of the two plug power supply electrodes on the plugging bolt are of inclined surface structures, contact surfaces of two socket power supply electrodes in the jack are also of inclined surface structures, and the inclined surfaces of the plug power supply electrodes are parallel to the inclined surfaces of the corresponding socket power supply electrodes. A contact surface of the plug grounding electrode on the plugging bolt is of an inclined surface structure, a contact surface of a socket grounding electrode in the jack is also of an inclined surface structure, and the inclined surface of the plug grounding electrode is parallel to the inclined surface of the socket grounding electrode. The metal contacts are electrically connected by using parallel inclined surfaces. When the plug is inserted into the socket, the corresponding metal contacts remain parallel, and the contact surfaces contact each other at the same time, thus avoiding the phenomenon of point discharge, ensuring the largest contact area during the electrical connection, and reducing heat emission of the plug and the socket. Moreover, a larger current is allowed to run through the electrical connection device, the electrical connection is more stable and reliable, and the service life is prolonged.

(6) In the straight insertion self-locking anti-explosion electrical connection device of the present invention, the socket has a housing and a socket substrate. Two or three power supply electrode mounting positions, two socket self-locking portion mounting positions, one grounding electrode mounting position, and one wiring position are provided inside the socket substrate. The socket power supply electrodes, the socket self-locking portions, and the socket grounding electrode are respectively and correspondingly mounted in the power supply electrode mounting positions, the socket self-locking portion mounting positions, and the grounding electrode mounting position. The structural design is reasonable. The plug receives balanced forces. Through accurate cooperation between an orientation positioning pillar and an orientation positioning hole, the plug is located at a relatively fixed position in the socket, and may not get loose to cause an unstable electrical connection.

(7) In the straight insertion self-locking anti-explosion electrical connection device of the present invention, the socket further includes a floating support cover sleeved on the orientation positioning pillar, a support spring is provided below the floating support cover, and the floating support cover is limited at the jack by the housing and is capable of moving on the orientation positioning pillar with insertion or pullout of the plug. The floating support cover can not only prevent dust from entering the socket to affect the performance of the socket, but also prevent an electric shock to a user. More importantly, the floating support cover keeps pressing against the plug. When the plug is excessively inserted, the floating support cover can reset the plug to ensure power connection with the largest contact area. When the plug is not inserted in place, the floating support cover enables the plug to pop out, to remind the user to reinsert the plug.

(8) In the straight insertion self-locking anti-explosion electrical connection device of the present invention, the socket self-locking portion includes a fixed base, a taper sleeve, a locking member, and a self-locking spring. The fixed base is mounted on the socket substrate, the taper sleeve is embedded in a mounting hole of the fixed base, the locking member is disposed inside the taper sleeve, a front portion of the locking member is limited by a front-end taper angle of the taper sleeve and a rear portion thereof is tightly pressed by the self-locking spring, and a rear end of the self-locking spring presses against the socket substrate. The socket self-locking portion has a simple structure and is subtly designed. The taper sleeve can limit the locking member from popping out, and can also be used for mounting the spring; and is convenient to process and fabricate. In addition, a positioning slot is further provided on the fixed base, and the positioning slot matches with a positioning pillar provided on the socket substrate to implement positioning, thereby ensuring that the socket self-locking portion is accurately positioned in the socket substrate.

(9) In the straight insertion self-locking anti-explosion electrical connection device of the present invention, the socket power supply electrode and the socket grounding electrode are implemented by using two different structures. Power supply electrode contacts in the socket power supply electrode are directly inserted on an electrode mounting seat through a clamping slot. The inclined surfaces of the power supply electrode contacts form suitable angles during one-time assembly, to ensure that the corresponding inclined surfaces completely parallel to each other. A grounding electrode contact of the socket grounding electrode is sleeved on a contact positioning pillar, such that the grounding electrode contact can only move along the axial direction of the contact positioning pillar and is stably mounted. On the premise of ensuring contact between corresponding electrodes, a power supply electrode push spring and a grounding electrode push spring can timely compensate for a contact error of metal contacts and electrode abrasion caused by long-term use, such that the corresponding contacts keep attaching to each other completely, thus prolonging the service life.

(10) In the straight insertion self-locking anti-explosion electrical connection device of the present invention, a dustproof and waterproof protective cover is further sleeved on the plugging bolt. After the plug is inserted into the socket, the protective cover just covers the jack, thus preventing water or dust from entering the socket to affect the performance of the electrical connection.

DESCRIPTION OF REFERENCE NUMERALS IN THE SCHEMATIC DIAGRAMS

100. plug, 11. first plugging pillar, 111. plug grounding electrode, 112. plug self-locking portion; 12. second plugging pillar, 121. plug power supply electrode, 13. orientation positioning hole, 14. protective cover; 200. socket, 21. housing, 211. jack, 212. notch, 22. socket substrate, 221. orientation positioning pillar, 222. power supply electrode mounting position, 223. travel limiting slot, 224. socket self-locking portion mounting position, 225. positioning pillar, 226. grounding electrode mounting position, 227. wiring position, 23. floating support cover, 231. support spring, 24. socket self-locking portion, 241. fixed base, 242. taper sleeve, 243. clamping and locking member, 244. positioning slot, 245. self-locking spring, 25. socket power supply electrode, 251. electrode mounting seat, 252. positioning protrusion, 253. power supply electrode contact, 254. clamping slot, 255. barrier block, 256. spring fixing pillar, 257. power supply electrode push spring, 26. socket grounding electrode, 261. contact positioning pillar, 262. grounding electrode contact, 263. inclined surface, 264. retainer, 265. grounding electrode push spring, 27. auxiliary push mechanism.

DETAILED DESCRIPTION OF THE EMBODIMENTS

To further understand the content of the present invention, the present invention is described in detail below with reference to the accompanying drawings and embodiments.

Embodiment

Referring to FIG. 1 to FIG. 5 and FIG. 11 to FIG. 13, a straight insertion self-locking anti-explosion electrical connection device of the present embodiment includes a plug 100 and a socket 200 adapted to the plug 100. The plug 100 can be directly inserted into the socket 200 along an insertion direction to form an electrical connection.

Figure 1:
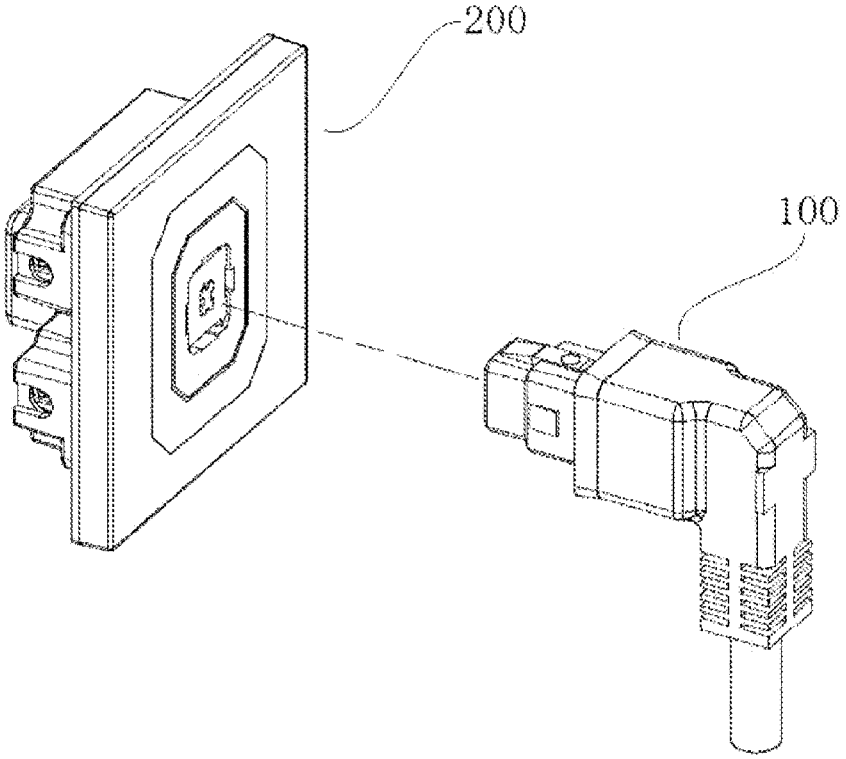
FIG. 1 is a schematic structural diagram of a straight insertion self-locking anti-explosion electrical connection device according to the present invention.
Figure 2:
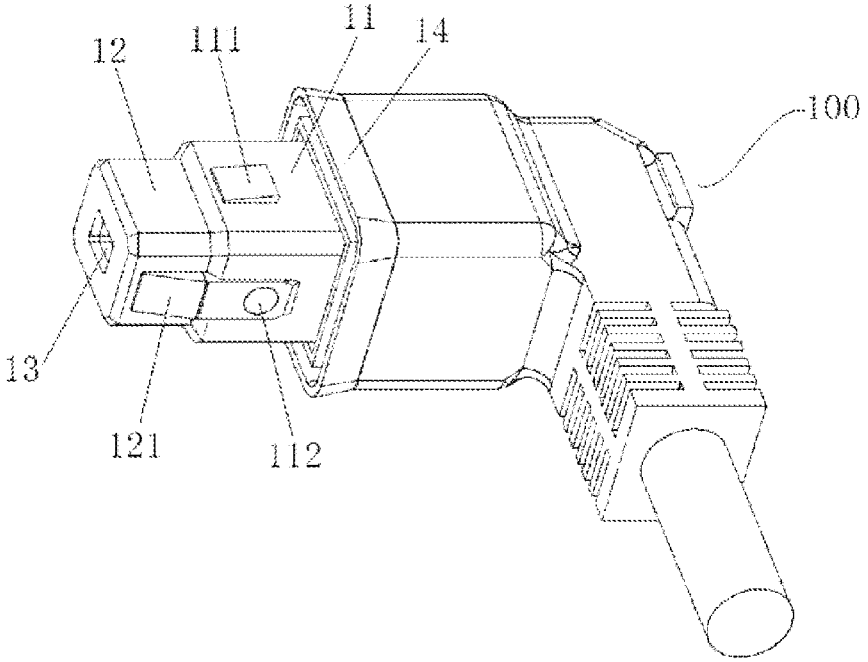
FIG. 2 is a schematic structural diagram of a plug according to the present invention.
Figure 3:
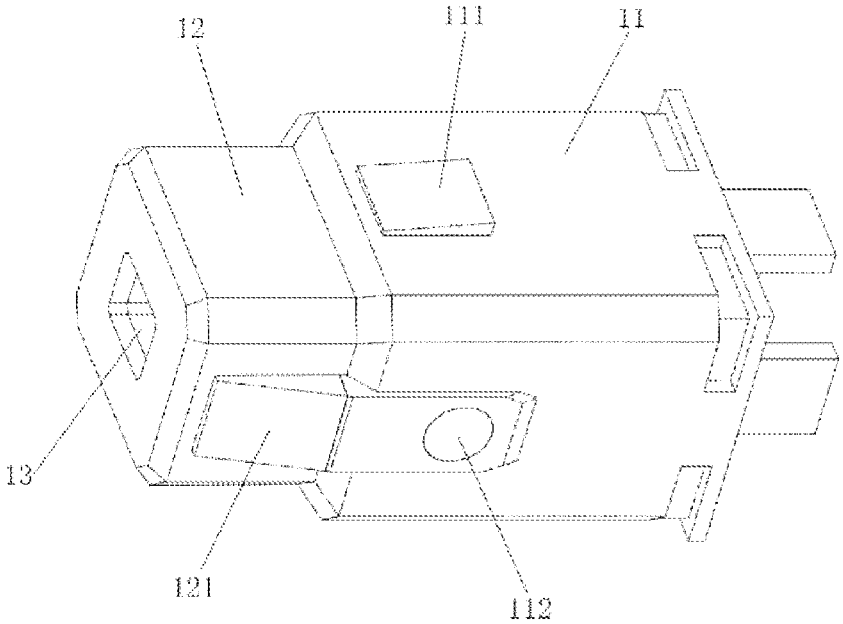
FIG. 3 is a schematic partial structural diagram of the plug according to the present invention.

As shown in FIG. 2 and FIG. 3, the plug 100 is provided with a plugging bolt. The plugging bolt is provided with two or more plug power supply electrodes 121 and a plug grounding electrode 111. For example, the plugging bolt is of a cube-shaped structure shown in FIG. 2. When two plug power supply electrodes 121 are provided, they are separately disposed on opposite surfaces of the cube-shaped plugging bolt, and the plug grounding electrode 111 is disposed on another side surface. If three plug power supply electrodes 121 are provided, two of them are separately disposed on opposite surfaces of the cube-shaped plugging bolt, the plug grounding electrode 111 may be disposed on another side surface, and the other plug power supply electrode 121 may be disposed on a surface opposite to the plug grounding electrode 111. Definitely, the shape of the plugging bolt in the present embodiment is not limited to a cube, and may also be a cylinder or other shapes. Locations of the plug power supply electrodes 121 and the plug grounding electrode 111 may also be designed according to the shape of the plugging bolt and an actual requirement. A side wall of the plugging bolt is further provided with one or more plug self-locking portions 112. The plug self-locking portion 112 is a circular hole, or a groove or a bump with a curved surface structure. An orientation positioning hole 13 is further provided on the plugging bolt in an insertion direction.

Figure 4:
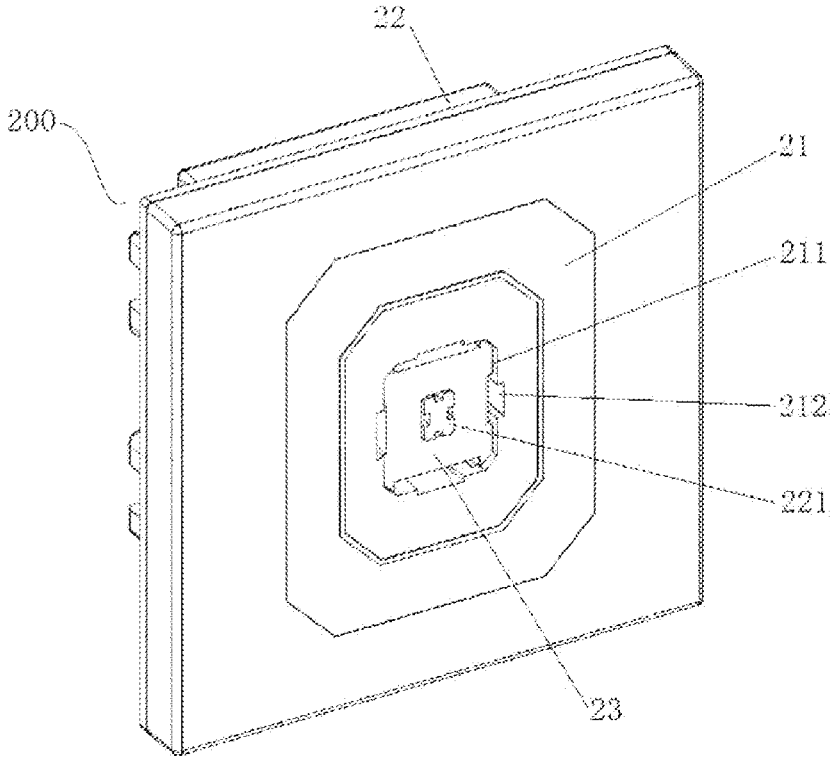
FIG. 4 is a schematic structural diagram of a socket according to the present invention.
Figure 5:
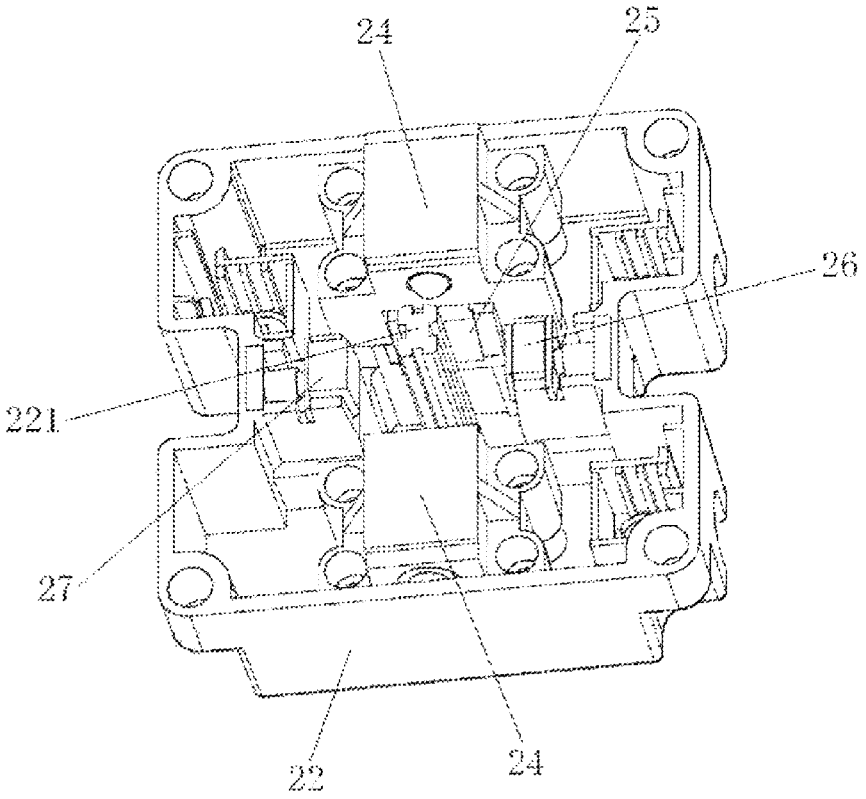
FIG. 5 is a schematic internal structural diagram of the socket according to the present invention.

As shown in FIG. 4 and FIG. 5, the socket 200 is provided with a jack 211 adapted to the plugging bolt. A wall of the jack 211 is provided with two or more socket power supply electrodes 25 and a socket grounding electrode 26 that respectively correspond to the two plug power supply electrodes 121 and the plug grounding electrode 111. The wall of the jack 211 is further provided with socket self-locking portions 24 corresponding to the plug self-locking portions 112. Each socket self-locking portion 24 is provided with a clamping and locking member 243 having a convex or concave surface structure or a circular hole. The clamping and locking member 243 matches with the plug self-locking portion 112. An orientation positioning pillar 221 matching with the orientation positioning hole 13 is further provided in the jack 211. Specifically, when the plug self-locking portion 112 is a circular hole or a groove with a curved surface structure, the clamping and locking member 243 matching with the plug self-locking portion 112 has a convex surface structure, and the hole radius of the plug self-locking portion 112 corresponds to the size of the convex surface structure of the clamping and locking member 243. When the plug self-locking portion 112 is a bump with a curved surface structure, the clamping and locking member 243 matching with the plug self-locking portion 112 has a concave surface structure or is a circular hole, and the hole radius of the clamping and locking member 243 corresponds to the size of the curved surface structure of the bump of the plug self-locking portion 112. In the present embodiment, as a preferred solution, the plug self-locking portion 112 is preferably a groove with a curved surface structure, the socket self-locking portion 24 preferably has the clamping and locking member 243 with a convex surface structure, and the curved surface structures of the plug self-locking portion 112 and the clamping and locking member 243 are of hemispherical shapes with identical radiuses. The clamping and locking member 243 may be directly designed into a spherical marble. When the plug 100 is inserted into the socket 200, the clamping and locking member 243 pops out and is embedded into the plug self-locking portion 112, thus achieving smooth engagement. The plug 100 may not pop out without an external force. When an outward pulling force is applied to the plug 100, the plug can be easily pulled out through cooperation between the clamping and locking member 243 and the plug self-locking portion 112, which facilitates use and achieves rapid disconnection. In addition, during insertion of the plug, the plug naturally moves into the socket because of the curved surface structures of the plug self-locking portion 112 and the socket self-locking portion 24, and a "click" sound can be heard, ensuring that contacts can completely contact each other in an instant. In one embodiment, a fitting depth between the clamping and locking member 243 and the plug self-locking portion 112 is 0.3 mm, and a fitting gap between the orientation positioning hole 13 and the orientation positioning pillar 221 is 0.2 mm. Two opposite plug self-locking portions 112 are disposed on the plugging bolt, and two socket self-locking portions 24 are correspondingly disposed. In this way, the plug 100 can be well retained by a self-locking depth of 0.6 mm, and can be easily pulled out under an outward pulling force. It should be noted that, when the plug 100 is fastened by using the plug self-locking portion 112 and the socket self-locking portion 24, the plug 100 can be pulled out only under a force in a direction opposite to the insertion direction, and is unlikely to withdraw under a force in other directions. Therefore, the plug may not pop out under an external force in other directions, and a problem that contacts are in poor contact with each other as a rotary socket is easily rotated back under an external force may not occur.

In the straight insertion self-locking anti-explosion electrical connection device of the present embodiment, the plug 100 is directly inserted into the jack 211 of the socket 200 with the plugging bolt, and is fastened through cooperation between the socket self-locking portions 24 in the socket 200 and the plug self-locking portions 112 on the plug 100. The plug power supply electrodes 121 and the plug grounding electrode 111 on the plug 100 respectively and correspondingly contact the socket power supply electrodes 25 and the socket grounding electrode 26 in the socket 200 sufficiently to enable power connection. The plug 100 is pulled out for disconnection against a fastening force from the socket self-locking portions 24 under an external force in a direction opposite to the insertion direction. Different from the prior art, in the present embodiment, the plug 100 inserted into the socket 200 is fastened through cooperation between the socket self-locking portions 24 and the plug self-locking portions 112 that have simple structures, thus achieving stable electrical contact. The plug 100 can be pulled out directly against a force from a self-locking structure, and can be disconnected conveniently and rapidly. The plug can be directly inserted into and pulled out of the socket, thus achieving a safe and reliable effect. The orientation positioning pillar 221 and the orientation positioning hole 13 precisely match with each other, such that the plug 100 and the socket 200 are accurately positioned and not easily get loose, thus ensuring sufficient contact between the metal contacts.

As shown in FIG. 2 and FIG. 3, the plugging bolt in the present embodiment is formed by a first plugging pillar 11 and a second plugging pillar 12 with outline dimensions descending along the insertion direction. The plug grounding electrode 111 is provided on a side surface of the first plugging pillar 11, the plug power supply electrodes 121 are provided on side surfaces of the second plugging pillar 12, and the plug self-locking portion 112 is provided on a side surface of the first plugging pillar 11. An objective of designing the plugging bolt into the first plugging pillar 11 and the second plugging pillar 12 with descending outline dimensions is as follows. The plug grounding electrode 111 can be disposed on a portion of the plugging bolt near the outside, such that a large distance is formed between the electrodes to prevent the electrodes from affecting each other, and a large current is allowed to run through the plug. In addition, compared with a rotary plug, the plug grounding electrode 111 is arranged above the plug power supply electrodes 121, and therefore can first contact an electrode in the socket when the plug is directly inserted into the socket. Thus, an electrical connection requirement is met, and personal safety is ensured in the case of an electrical accident. Definitely, the plugging bolt in the present invention may also be made into a structure having no step, for example, a prism or a cylinder.

Figure 12:
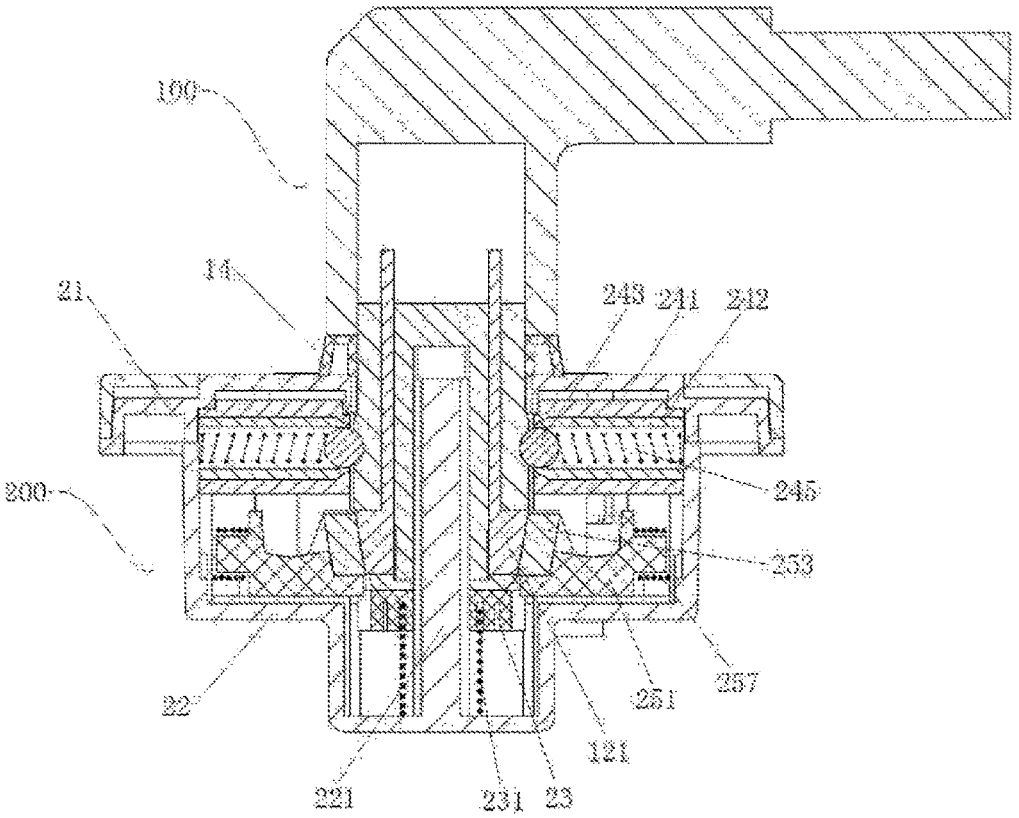
FIG. 12 is a schematic diagram along A-A in FIG. 11.
Figure 13:
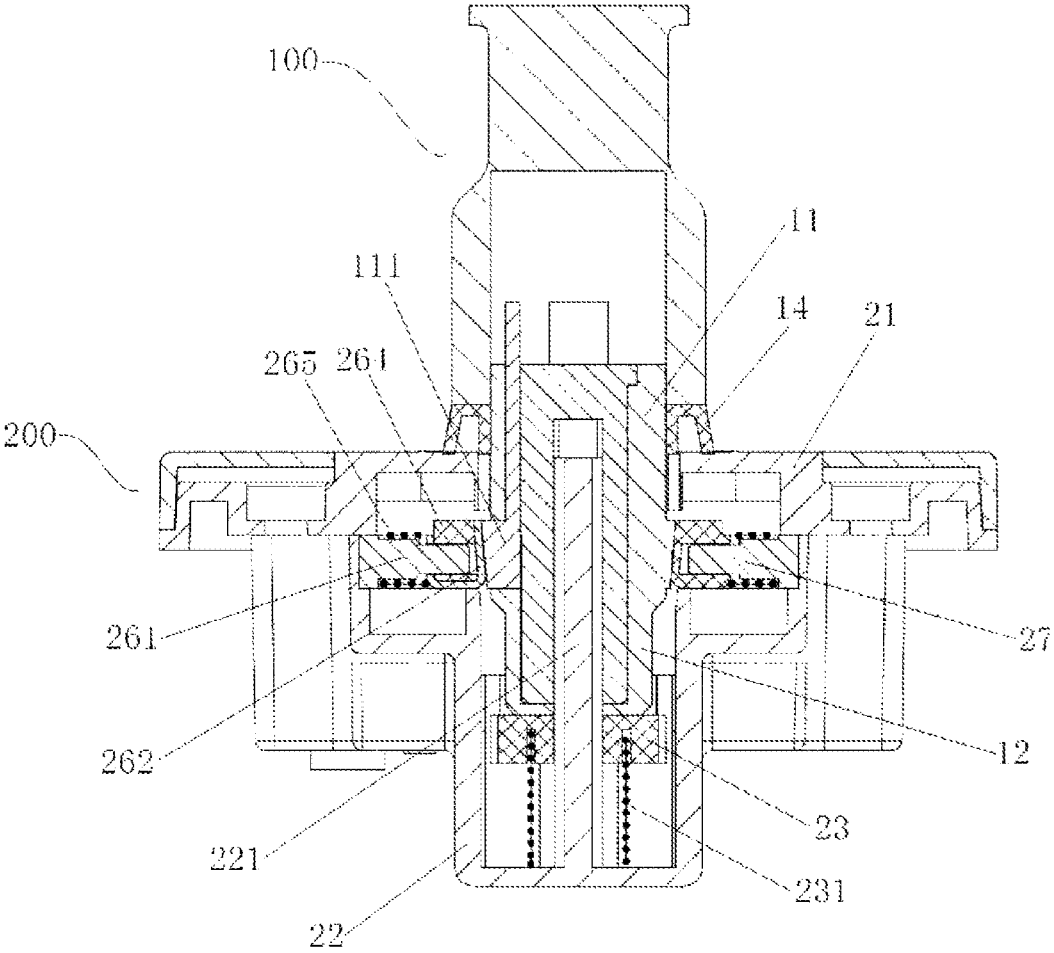
FIG. 13 is a schematic diagram along B-B in FIG. 11.
Figure 14:
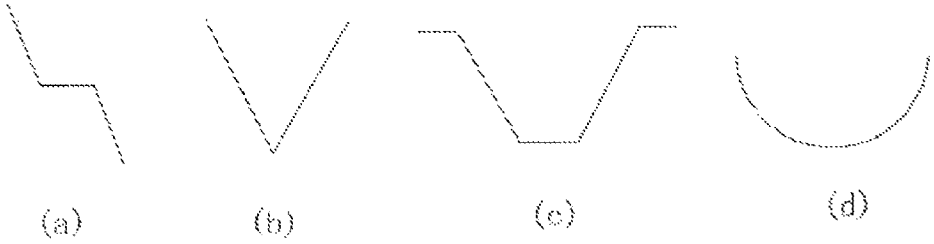
FIG. 14 shows several forms of contact surfaces of electrode contacts on a plug and a socket in the present invention.

In the straight insertion self-locking anti-explosion electrical connection device of the present invention, the metal contacts in the plug 100 and the socket 200 may contact in a horizontal direction or a perpendicular direction to enable power connection. The metal contacts may be mounted on a side surface or a lower end surface of the plugging bolt. When the metal contacts are disposed on the lower end surface of the plugging bolt, the contact surfaces of the metal contacts may be designed into arc surfaces, tapered surfaces, or bent surfaces (referring to (b), (c), and (d) in FIG. 14), as long as the contact surfaces of the plug contacts and the socket contacts are parallel. However, in the present embodiment, as shown in FIG. 12 and FIG. 13, different from the prior art, contact surfaces of the plug power supply electrodes 121 on the plugging bolt in the present embodiment are of inclined surface structures. It should be understood that, the inclined surface structure includes an entire inclined surface and also includes an inclined surface with bents (referring to (a) in FIG. 14), that is, a bent surface. The bent surface structure still only needs to ensure parallel contact between the contacts of the plug and the socket. Contact surfaces of the socket power supply electrodes 25 in the jack 211 are also of inclined surface structures, and the inclined surfaces of the plug power supply electrodes 121 are parallel to the inclined surfaces of the corresponding socket power supply electrodes 25. A contact surface of the plug grounding electrode 111 on the plugging bolt is of an inclined surface structure, a contact surface of the socket grounding electrode 26 in the jack 211 is also of an inclined surface structure, and the inclined surface of the plug grounding electrode 111 is parallel to the inclined surface of the socket grounding electrode 26. The metal contacts are electrically connected by using parallel inclined surfaces. When the plug 100 is inserted into the socket, the corresponding metal contacts remain parallel, and the contact surfaces contact each other at the same time, thus achieving instant and stable electrical contact, avoiding the phenomenon of point discharge, ensuring the largest contact area during the electrical connection, and reducing heat emission of the plug 100 and the socket 200. Moreover, a larger current is allowed to run through the electrical connection device, the electrical connection is more stable and reliable, and the device is safer to use and has prolonged service life. When the plug 100 is pulled out, the metal contacts are also completely separated from each other instantly without causing an electric spark, such that the device is truly anti-explosion, enables direct insertion and pullout, and is safe and reliable. In addition, as shown in FIG. 13, a protrusion having an inclined surface symmetrical with that of the plug grounding electrode 111 is disposed on a side of the plugging bolt opposite to the plug grounding electrode 111 in the present embodiment. An auxiliary push mechanism 27 at a position corresponding to that of the protrusion is disposed in the jack 211. The auxiliary push mechanism 27 also has an inclined surface parallel to that of the protrusion. In this way, the plug 100 receives balanced forces and may not tilt after being inserted into the socket. The metal contacts contact each other more closely and stably, thus ensuring desirable performance of the electrical connection.

Figure 6:
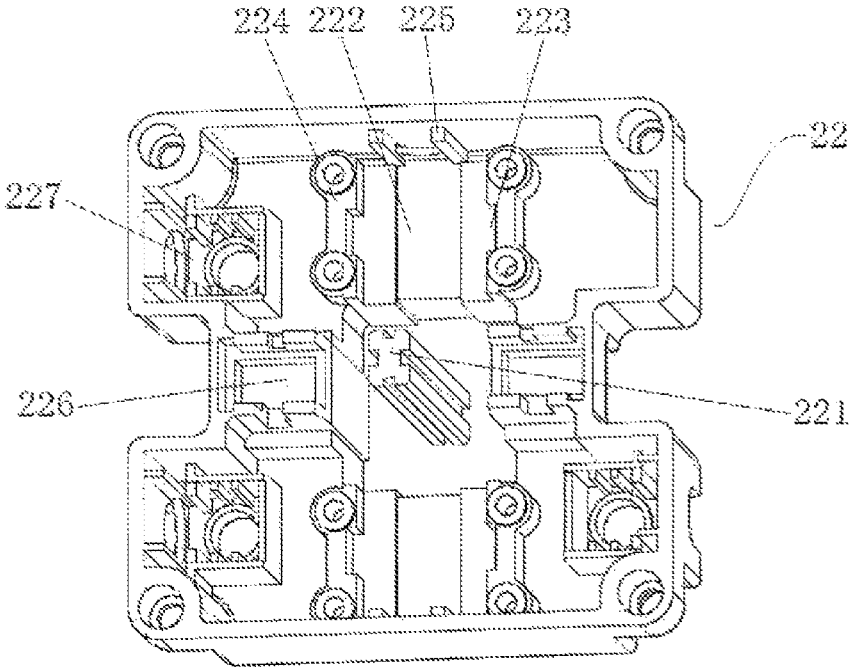
FIG. 6 is a schematic structural diagram of a socket substrate in the present invention.

Referring to FIG. 4, FIG. 5, and FIG. 6, the socket 200 in the present embodiment has a housing 21 and a socket substrate 22. The housing 21 is fixed on the socket substrate 22 by using four screws. The jack 211 is opened at a middle position of the housing 21. A rib plate that firmly fits the plugging bolt is further provided around the jack 211. The rib plate increases the contact between the jack 211 and the plugging bolt, such that the plug 100 can be inserted into the socket more accurately. When two plug power supply electrodes 121 are provided on the plug, that is, when the electrical connection device of the present invention is a two-phase electrical connection device, two power supply electrode mounting positions 222, two socket self-locking portion mounting positions 224, one grounding electrode mounting position 226, and one wiring position 227 are provided inside the socket substrate 22, the two power supply electrode mounting positions 222 being oppositely disposed, and the two socket self-locking portion mounting positions 224 also being oppositely disposed. When three plug power supply electrodes 121 are provided on the plug, that is, when the electrical connection device of the present invention is a three-phase electrical connection device, three power supply electrode mounting positions 222, two socket self-locking portion mounting positions 224, one grounding electrode mounting position 226, and one wiring position 227 are provided inside the socket substrate 22, two of the three power supply electrode mounting positions 222 being oppositely disposed and the other one being disposed in a direction perpendicular to a connecting line between the two opposite power supply electrode mounting positions 222, and the two socket self-locking portion mounting positions 224 being oppositely disposed. The socket power supply electrodes 25, the socket self-locking portions 24, and the socket grounding electrode 26 are respectively and correspondingly mounted in the power supply electrode mounting positions 222, the socket self-locking portion mounting positions 224, and the grounding electrode mounting position 226. The socket self-locking portions 24 are fixed above the socket power supply electrodes 25. With the foregoing structural arrangement of the socket substrate 22, the inner space of the socket 200 is properly used and the structure is compactly arranged. The plug 100 receives balanced forces. Through accurate cooperation between the orientation positioning pillar 221 and the orientation positioning hole 13, the plug 100 is located in the socket 200 at a relatively fixed position, and may not get loose to cause an unstable electrical connection. In addition, the socket 200 further includes a floating support cover 23 (as shown in FIG. 4, FIG. 12, and FIG. 13) sleeved on the orientation positioning pillar 221, a support spring 231 is provided below the floating support cover 23, and the floating support cover 23 is limited at the jack 211 by the housing 21 and is capable of moving on the orientation positioning pillar 221 with insertion or pullout of the plug 100. In the present embodiment, the floating support cover 23 can not only prevent dust from entering the socket 200 to affect the performance of the socket 200, but also prevent an electric shock to a user. More importantly, the floating support cover 23 keeps pressing against the plug 100. When the plug 100 is excessively inserted, the floating support cover can reset the plug 100, to ensure power connection with the largest contact area. When the plug 100 is not inserted in place, the floating support cover enables the plug 100 to pop out, to remind the user to reinsert the plug 100.

Figure 7:
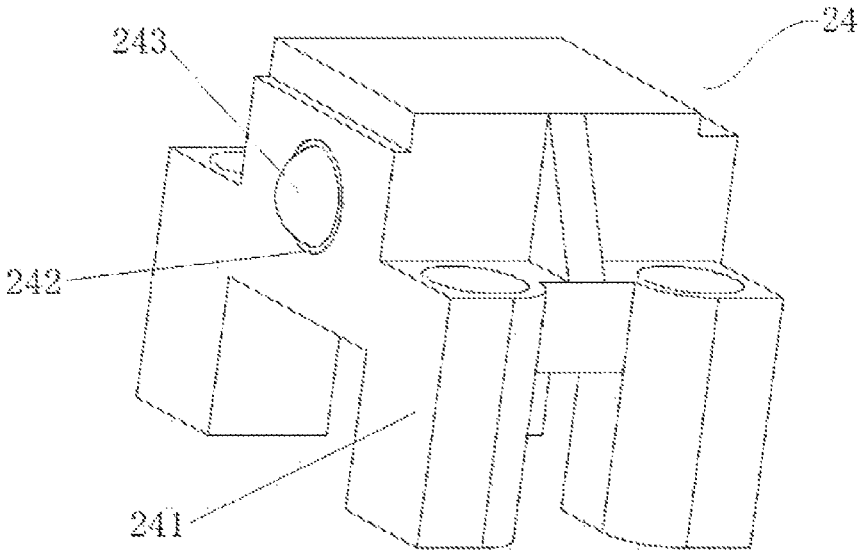
FIG. 7 and FIG. 8 are schematic structural diagrams of a socket self-locking portion in the present invention (a spring is not shown)
Figure 8:
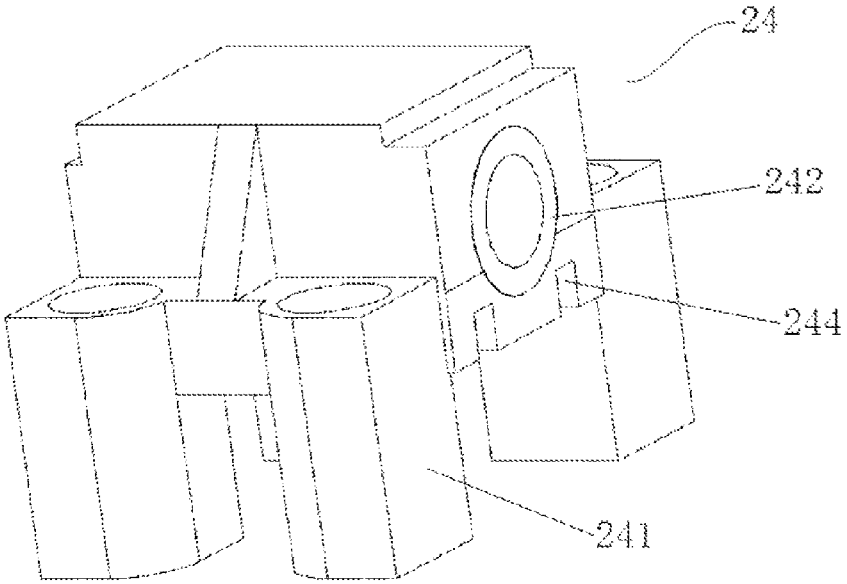

As shown in FIG. 7 and FIG. 8, in the straight insertion self-locking anti-explosion electrical connection device of the present embodiment, the socket self-locking portion 24 in the socket 200 includes a fixed base 241, a taper sleeve 242, a clamping and locking member 243, a self-locking spring 245, and an insert plate. The fixed base 241 is mounted on the socket substrate 22 by using four screws. Grooves are provided at the bottom of four legs where the screws are mounted of the fixed base 241, and a protrusion is disposed at a corresponding position of the socket substrate 22, such that the fixed base 241 can be conveniently positioned. The taper sleeve 242 is embedded in a mounting hole of the fixed base 241, the clamping and locking member 243 (a marble) is disposed inside the taper sleeve 242, a front portion of the clamping and locking member 243 is limited by a front-end taper angle of the taper sleeve 242 and a rear portion thereof is tightly pressed by the self-locking spring 245, and a rear end of the self-locking spring 245 presses against the insert plate that is inserted into a rear end of the fixed base 241. In addition, to ensure that the socket self-locking portion 24 is positioned more accurately in the socket substrate 22, a positioning slot 244 is further provided on the fixed base 241. The positioning slot 244 matches with a positioning pillar 225 provided on the socket substrate 22 to implement positioning. The socket self-locking portion 24 in the present embodiment has a simple structure and is subtly designed. The taper sleeve 242 can limit the clamping and locking member 243 from popping out, and can also be used for mounting the spring; and is convenient to process and fabricate.

Figure 9:
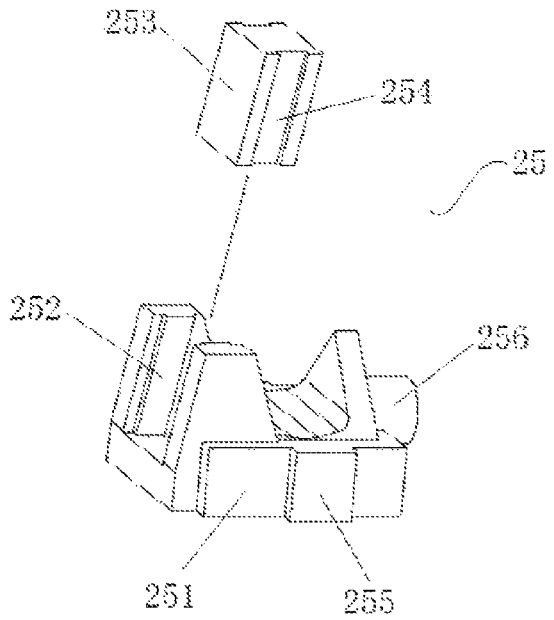
FIG. 9 is a schematic structural diagram of a socket power supply electrode in the present invention (a spring is not shown)

As shown in FIG. 9, the socket power supply electrode 25 of the socket 200 in the present embodiment includes an electrode mounting seat 251, a power supply electrode contact 253, and a power supply electrode push spring 257. The electrode mounting seat 251 is mounted in a slide slot provided on the socket substrate 22, and matches with travel limiting slots 223 disposed at two sides of the slide slot by using barrier blocks 255 provided at two sides of the electrode mounting seat 251. The electrode mounting seat 251 can only move in the travel limiting slots 223, thus avoiding the socket power supply electrodes 25 from excessively moving forward to cause retaining of the plug 100 in the insertion direction. The power supply electrode contact 253 has a parallelogram structure, a clamping slot 254 being provided on a side thereof. A positioning protrusion 252 is provided on a front end of the electrode mounting seat 251. The power supply electrode contact 253 is fitly inserted on the positioning protrusion 252 of the electrode mounting seat 251 through the clamping slot 254. A withdrawal prevention hook (not shown) for preventing the power supply electrode contact 253 from withdrawing is provided on an upper end of the positioning protrusion 252. The inclined surfaces of the power supply electrode contacts form suitable angles during one-time assembly, to ensure that the corresponding inclined surfaces completely parallel to each other. A spring fixing pillar 256 is provided at a rear end of the electrode mounting seat 251, and the power supply electrode push spring 257 is sleeved on the spring fixing pillar 256. On the premise of ensuring contact between corresponding electrodes, the power supply electrode push spring 257 can timely compensate for a contact error of metal contacts and electrode abrasion caused by long-term use, such that the corresponding contacts keep attaching to each other completely, thus prolonging the service life.

Figure 10:
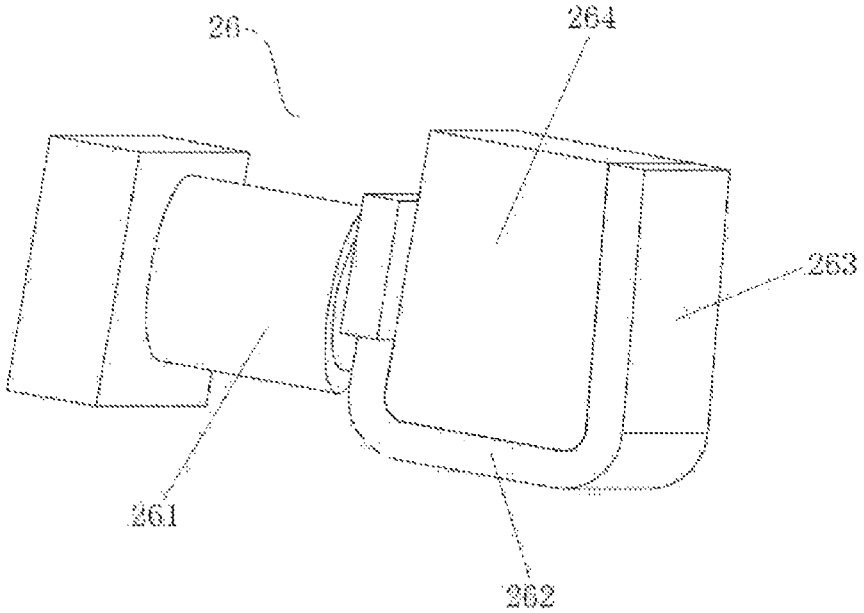
FIG. 10 is a schematic structural diagram of a socket grounding electrode in the present invention (a spring is not shown)
Figure 11:
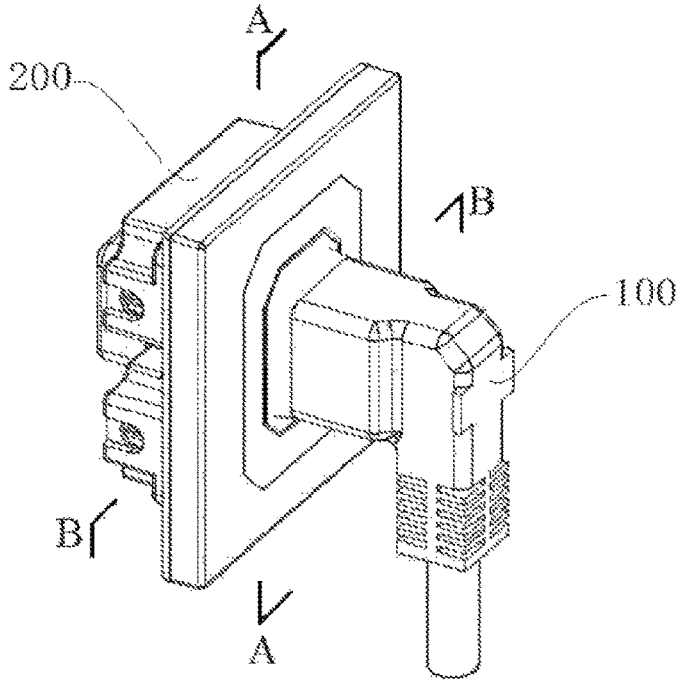
FIG. 11 is a schematic diagram illustrating the use state of a plug and a socket in the present invention.

As shown in FIG. 10, in the present embodiment, the socket grounding electrode 26 of the socket 200 adopts a structural design different from that of the socket power supply electrode 25, and includes a contact positioning pillar 261, a grounding electrode contact 262, a retainer 264, and a grounding electrode push spring 265. A rear portion of the contact positioning pillar 261 is inserted on the socket substrate 22 by using a fixer. The grounding electrode contact 262 has a U-shaped structure, a front end thereof is an inclined surface 263 and a rear end thereof is provided with a mounting hole. The grounding electrode contact 262 is mounted on the contact positioning pillar 261 through the mounting hole. The retainer 264 is stuck in U-shaped space of the grounding electrode contact 262, and a hole is further provided on the retainer 264 for being sleeved on the contact positioning pillar 261. The retainer 264 is provided to prevent a problem that the inclined surface 263 is unparallel to the inclined surfaces of the contacts on the plug due to shaking of the grounding electrode contact 262 on the contact positioning pillar 261. Therefore, the grounding electrode contact 262 can only move along the axial direction of the contact positioning pillar 261, and is stably mounted. The grounding electrode push spring 265 is sleeved on the contact positioning pillar 261, and is located between the fixer of the contact positioning pillar 261 and the grounding electrode contact 262. A stopper for a limiting purpose is further provided on a side of the grounding electrode contact 262. Similar to the power supply electrode push spring 257, the grounding electrode push spring 265 can also compensate for a contact error of the metal contacts, such that the corresponding contacts can completely contact each other.

Moreover, in order to simplify the structure of the socket grounding electrode 26, in one embodiment, another structure of the socket grounding electrode 26 is further provided, which includes a contact positioning pillar 261, a grounding electrode contact 262, and a grounding electrode push spring 265. A rear portion of the contact positioning pillar 261 is inserted on the socket substrate 22 by using a fixer. The grounding electrode contact 262 has a block-shaped structure with an inclined surface 263, and a rear end of the grounding electrode contact 262 is provided with a mounting hole. The grounding electrode contact 262 is mounted on the contact positioning pillar 261 through the mounting hole. The grounding electrode push spring 265 is sleeved on the contact positioning pillar 261, and is located between the fixer of the contact positioning pillar 261 and the grounding electrode contact 262. A stopper for a limiting purpose is further provided on a side of the grounding electrode contact 262. Compared with the first structure of the socket grounding electrode 26, this structure omits the retainer 264, and the grounding electrode contact 262 is designed into a block-shaped structure, thus simplifying the structure of the socket grounding electrode 26 and facilitating assembly.

It should be noted that, in the present embodiment, the specific structures of the socket power supply electrode 25 and the socket grounding electrode 26 are merely one or more preferred solutions of the present invention, and the protection scope of the present invention is not limited thereto. Provided that corresponding metal contacts contact each other by using parallel inclined surface structures in the present invention to enable power connection, any contact push structures meeting such a condition all fall within the protection scope of the present invention.

The structures of the plug 100 and the socket 200 in the straight insertion self-locking anti-explosion electrical connection device have been described above. The structures of the plug 100 and the socket 200 are further described below with reference to the accompanying drawings.

As shown in FIG. 2 and FIG. 3, a plug in the present embodiment includes a plugging bolt. The plugging bolt is provided with two or more plug power supply electrodes 121 and a plug grounding electrode 111. A side wall of the plugging bolt is further provided with one or more plug self-locking portions 112, for example, one, two, or three plug self-locking portions 112 are disposed. The plug self-locking portion 112 is a circular hole, or a groove or a bump with a curved surface structure, and matches with a clamping and locking member 243 provided on a socket. An orientation positioning hole 13 is further provided on the plugging bolt in an insertion direction. Specifically, the plugging bolt is formed by a first plugging pillar 11 and a second plugging pillar 12 with outline dimensions descending along the insertion direction. The plug grounding electrode 111 is provided on a side surface of the first plugging pillar 11, the plug power supply electrodes 121 are provided on side surfaces of the second plugging pillar 12, and the plug self-locking portion 112 is provided on a side surface of the first plugging pillar 11 and is disposed above the plug power supply electrodes 121. Preferably, the curved surface structure of the plug self-locking portion 112 is of a hemispherical shape, and two opposite plug self-locking portions 112 are disposed on the first plugging pillar 11.

In the plug of the present embodiment, contact surfaces of the plug power supply electrodes 121 on the plugging bolt are of inclined surface structures, and the inclined surfaces of the plug power supply electrodes 121 are parallel to inclined surfaces of corresponding power supply electrodes on the socket. A contact surface of the plug grounding electrode 111 on the plugging bolt is also of an inclined surface structure, and the inclined surface of the plug grounding electrode 111 is parallel to an inclined surface of a corresponding grounding electrode on the socket. In addition, a protrusion having an inclined surface symmetrical with that of the plug grounding electrode 111 is disposed on a side of the plugging bolt opposite to the plug grounding electrode 111, the width of the protrusion being unequal to that of the plug grounding electrode 111. The two plug self-locking portions 112 are separately located above the two plug power supply electrodes 121, and the surface on which the plug self-locking portion 112 is located is just connected to an upper end of the inclined surface of the plug power supply electrode 121. During insertion of the plug 100, the clamping and locking member 243 matching with the plug self-locking portion 112 can conveniently slide into the plug self-locking portion 112 to implement self-locking, such that the plug can be inserted into the socket smoothly. The metal contacts are electrically connected by using parallel inclined surfaces. When the plug 100 is inserted into the socket 200, the corresponding metal contacts remain parallel, and the contact surfaces contact each other at the same time, thus avoiding the phenomenon of point discharge, ensuring the largest contact area during the electrical connection, and reducing heat emission of the plug and the socket. Moreover, a larger current is allowed to run through the electrical connection device, and the electrical connection is more stable and reliable.

As shown in FIG. 2, in the present embodiment, a dustproof and waterproof protective cover 14 is further sleeved on the plugging bolt. After the plug 100 is inserted into the socket 200, the protective cover 14 just covers the jack 211, thus preventing water or dust from entering the socket 200 to affect the performance of the electrical connection.

As shown in FIG. 4 to FIG. 13, a socket of the present embodiment includes a jack 211 adapted to the plugging bolt. A wall of the jack 211 is provided with two or more socket power supply electrodes 25 and a socket grounding electrode 26. The wall of the jack 211 is further provided with one or more socket self-locking portions 24 for achieving a self-locking effect together with the plug self-locking portion 112 on the plug. Each socket self-locking portion 24 is provided with a clamping and locking member 243 having a convex or concave surface structure or a circular hole. The clamping and locking member 243 matches with the plug self-locking portion 112 provided on the plug. An orientation positioning pillar 221 is further provided in the jack 211. The number of the socket self-locking portions 24 is equal to the number of the plug self-locking portions 112 on the plug 100. Two opposite socket self-locking portions 24 are also disposed on the wall of the jack 211. The curved surface structure of the clamping and locking member 243 is also of a hemispherical shape. Specifically, the socket of the present embodiment has a housing 21 and a socket substrate 22. The housing 21 is provided on the socket substrate 22, the jack 211 is provided on a middle portion of the housing 21, and an edge of the jack 211 is provided with a notch 212. A rib plate that firmly fits the plugging bolt is further provided around the jack 211. As shown in FIG. 6, two power supply electrode mounting positions 222, two socket self-locking portion mounting positions 224, one grounding electrode mounting position 226, and one wiring position 227 are provided inside the socket substrate 22, the two power supply electrode mounting positions 222 being oppositely disposed, and the two socket self-locking portion mounting positions 224 also being oppositely disposed to form a two-phase electrical connection manner. Alternatively, three power supply electrode mounting positions 222, two socket self-locking portion mounting positions 224, one grounding electrode mounting position 226, and one wiring position 227 are provided inside the socket substrate 22, two of the three power supply electrode mounting positions 222 being oppositely disposed and the other one being disposed in a direction perpendicular to a connecting line between the two opposite power supply electrode mounting positions 222, and the two socket self-locking portion mounting positions 224 being oppositely disposed to form a three-phase electrical connection manner. The socket power supply electrodes 25, the socket self-locking portions 24, and the socket grounding electrode 26 are respectively and correspondingly mounted in the power supply electrode mounting positions 222, the socket self-locking portion mounting positions 224, and the grounding electrode mounting position 226. The socket self-locking portions 24 are fixed above the socket power supply electrodes 25. An auxiliary push mechanism mounting position may be further disposed inside the socket substrate 22, and an auxiliary push mechanism 27 is mounted on the auxiliary push mechanism mounting position. The auxiliary push mechanism 27 is located opposite to the socket grounding electrode 26, to ensure that the socket receives balanced forces. In addition, the socket 200 further includes a floating support cover 23 sleeved on the orientation positioning pillar 221, a support spring 231 is disposed below the floating support cover 23, and the floating support cover 23 is limited at the jack 211 by the housing 21 and is capable of moving on the orientation positioning pillar 221 with insertion or pullout of the plug.

Referring to FIG. 12 and FIG. 13, in the present embodiment, contact surfaces of the two socket power supply electrodes 25 in the jack 211 are of inclined surface structures, and the inclined surfaces of the socket power supply electrodes 25 are parallel to inclined surfaces of corresponding power supply electrodes on the plug. A contact surface of the socket grounding electrode 26 in the jack 211 is also of an inclined surface structure, and the inclined surface of the socket grounding electrode 26 is parallel to an inclined surface of a corresponding grounding electrode on the plug.

The structure of the auxiliary push mechanism 27 is similar to that of the socket grounding electrode 26. A difference therebetween lies in that, a push block is used to replace the U-shaped grounding electrode contact 262 and the retainer 264, or the block-shaped grounding electrode contact 262. The structural shape of the push block is nearly the same as that of the combination of the grounding electrode contact 262 and the retainer 264, or that of the block-shaped grounding electrode contact 262, such that the plug 100 receives balanced forces in the socket 200. In addition, for ease of assembly of the socket 200, in the present embodiment, a detachable heightening pad is further provided at a rear portion of the socket substrate 22 in the socket 200. During assembly, the heightening pad is sleeved on the socket substrate 22, to implement stable assembly of the socket 200.

The present invention provides a straight insertion self-locking anti-explosion electrical connection device, and a plug and a socket thereof. The plug can be directly inserted into or pulled out of the socket. After the plug is inserted into the socket, positioned by an orientation positioning pillar and an orientation positioning hole, and under balanced contact forces between metal contacts and socket self-locking portions, the plug is stably and reliably inserted in the socket. In this way, corresponding metal contacts having parallel inclined surfaces can instantly and stably contact each other with the largest contact area, thus avoiding occurrence of an electric spark and ensuring stability and safety of an electrical connection. The plug can be pulled out directly against a force from a self-locking structure, and can be disconnected conveniently and rapidly. The metal contacts are also completely separated from each other instantly without causing an electric spark, such that the device is truly anti-explosion and is safe and reliable. In conclusion, the straight insertion self-locking anti-explosion electrical connection device, and the plug and the socket thereof provided by the present invention enhance the convenience in use to the maximum extent on the premise of ensuring electrical safety; solve a problem that an existing electrical connection device easily causes spark discharge during power connection or disconnection; reduce heat emission produced after the plug is connected to the socket; and increase the maximum value of a current allowed to run through the plug and the socket.

The above exemplarily describes the present invention and the embodiments thereof, but the description is unrestricted. Only one of the embodiments of the present invention is shown in the accompanying drawings, and an actual structure is not limited thereto. Therefore, structural forms and embodiments, similar to the technical solution, that are designed without creative efforts and under the revelation of the present invention by persons of ordinary skill in the art without departing from the inventive objective of the present invention shall all fall within the protection scope of the present invention.

What is claimed is:

1. A straight insertion self-locking anti-explosion electrical connection device, comprising a plug (100) and a socket (200) adapted to the plug (100), wherein the plug (100) is provided with a plugging bolt, the plugging bolt is provided with two or more plug power supply electrodes (121) and a plug grounding electrode (111), a side wall of the plugging bolt is further provided with one or more plug self-locking portions (112), the plug self-locking portion (112) being a circular hole, or a groove or a bump with a curved surface structure, and an orientation positioning hole (13) is further provided on the plugging bolt in an insertion direction;

the socket (200) is provided with a jack (211) adapted to the plugging bolt, a wall of the jack (211) is provided with two or more socket power supply electrodes (25) and a socket grounding electrode (26) that respectively correspond to the plug power supply electrodes (121) and the plug grounding electrode (111); the wall of the jack (211) is further provided with socket self-locking portions (24) corresponding to the plug self-locking portions (112), each socket self-locking portion (24) is provided with a clamping and locking member (243) having a convex or concave surface structure or a circular hole, the clamping and locking member (243) matches with the plug self-locking portion (112), and an orientation positioning pillar (221) matching with the orientation positioning hole (13) is further provided in the jack (211); and the plug (100) is directly inserted into the jack (211) of the socket (200) with the plugging bolt, and is fastened through cooperation between the socket self-locking portions (24) in the socket (200) and the plug self-locking portions (112) on the plug (100), the plug power supply electrodes (121) and the plug grounding electrode (111) on the plug (100) respectively and correspondingly contact the socket power supply electrodes (25) and the socket grounding electrode (26) in the socket (200) sufficiently to enable power connection, and the plug (100) is pulled out for disconnection against a fastening force from the socket self-locking portions (24) under an external force in a direction opposite to the insertion direction, wherein the plugging bolt is formed by a first plugging pillar (11) and a second plugging pillar (12) with outline dimensions descending along the insertion direction; the plug grounding electrode (111) is provided on a side surface of the first plugging pillar (11), the plug power supply electrodes (121) are provided on side surfaces of the second plugging pillar (12), and the plug self-locking portion (112) is provided on a side surface of the first plugging pillar (11).

2. The straight insertion self-locking anti-explosion electrical connection device according to claim 1, wherein the curved surface structures of the plug self-locking portion (112) and the clamping and locking member (243) are of hemispherical shapes with identical radiuses.

3. The straight insertion self-locking anti-explosion electrical connection device according to claim 2, wherein contact surfaces of the plug power supply electrodes (121) on the plugging bolt are of inclined surface structures, contact surfaces of the socket power supply electrodes (25) in the jack (211) are also of inclined surface structures, and the inclined surfaces of the plug power supply electrodes (121) are parallel to the inclined surfaces of the corresponding socket power supply electrodes (25).

4. The socket according to claim 3, having a housing (21) and a socket substrate (22), wherein the housing (21) is provided on the socket substrate (22), the jack (211) is provided on a middle portion of the housing (21), and an edge of the jack (211) is provided with a notch (212); two power supply electrode mounting positions (222), two socket self-locking portion mounting positions (224), one grounding electrode mounting position (226), and one wiring position (227) are provided inside the socket substrate (22), the two power supply electrode mounting positions (222) being oppositely disposed, and the two socket self-locking portion mounting positions (224) also being oppositely disposed; alternatively, three power supply electrode mounting positions (222), two socket self-locking portion mounting positions (224), one grounding electrode mounting position (226), and one wiring position (227) are provided inside the socket substrate (22), two of the three power supply electrode mounting positions (222) being oppositely disposed and the other one being disposed in a direction perpendicular to a connecting line between the two opposite power supply electrode mounting positions (222), and the two socket self-locking portion mounting positions (224) being oppositely disposed; the socket power supply electrodes (25), the socket self-locking portions (24), and the socket grounding electrode (26) are respectively and correspondingly mounted in the power supply electrode mounting positions (222), the socket self-locking portion mounting positions (224), and the grounding electrode mounting position (226); and the socket self-locking portions (24) are fixed above the socket power supply electrodes (25).

5. The straight insertion self-locking anti-explosion electrical connection device according to claim 2, wherein two opposite plug self-locking portions (112) are disposed.

6. The straight insertion self-locking anti-explosion electrical connection device according to claim 5, wherein contact surfaces of the plug power supply electrodes (121) on the plugging bolt are of inclined surface structures, contact surfaces of the socket power supply electrodes (25) in the jack (211) are also of inclined surface structures, and the inclined surfaces of the plug power supply electrodes (121) are parallel to the inclined surfaces of the corresponding socket power supply electrodes (25).

7. The straight insertion self-locking anti-explosion electrical connection device according to claim 1, wherein contact surfaces of the plug power supply electrodes (121) on the plugging bolt are of inclined surface structures, contact surfaces of the socket power supply electrodes (25) in the jack (211) are also of inclined surface structures, and the inclined surfaces of the plug power supply electrodes (121) are parallel to the inclined surfaces of the corresponding socket power supply electrodes (25).

8. The socket according to claim 7, wherein contact surfaces of the socket power supply electrodes (25) in the jack (211) are of inclined surface structures, and the inclined surfaces of the socket power supply electrodes (25) are parallel to inclined surfaces of corresponding power supply electrodes on the plug; a contact surface of the socket grounding electrode (26) in the jack (211) is also of an inclined surface structure, and the inclined surface of the socket grounding electrode (26) is parallel to an inclined surface of a corresponding grounding electrode on the plug.

9. A straight insertion self-locking anti-explosion electrical connection device, comprising a plug (100) and a socket (200) adapted to the plug (100), wherein the plug (100) is provided with a plugging bolt, the plugging bolt is provided with two or more plug power supply electrodes (121) and a plug grounding electrode (111), a side wall of the plugging bolt is further provided with one or more plug self-locking portions (112), the plug self-locking portion (112) being a circular hole, or a groove or a bump with a curved surface structure, and an orientation positioning hole (13) is further provided on the plugging bolt in an insertion direction;

the socket (200) is provided with a jack (211) adapted to the plugging bolt, a wall of the jack (211) is provided with two or more socket power supply electrodes (25) and a socket grounding electrode (26) that respectively correspond to the plug power supply electrodes (121) and the plug grounding electrode (111); the wall of the jack (211) is further provided with socket self-locking portions (24) corresponding to the plug self-locking portions (112), each socket self-locking portion (24) is provided with a clamping and locking member (243) having a convex or concave surface structure or a circular hole, the clamping and locking member (243) matches with the plug self-locking portion (112), and an orientation positioning pillar (221) matching with the orientation positioning hole (13) is further provided in the jack (211); and the plug (100) is directly inserted into the jack (211) of the socket (200) with the plugging bolt, and is fastened through cooperation between the socket self-locking portions (24) in the socket (200) and the plug self-locking portions (112) on the plug (100), the plug power supply electrodes (121) and the plug grounding electrode (111) on the plug (100) respectively and correspondingly contact the socket power supply electrodes (25) and the socket grounding electrode (26) in the socket (200) sufficiently to enable power connection, and the plug (100) is pulled out for disconnection against a fastening force from the socket self-locking portions (24) under an external force in a direction opposite to the insertion direction, wherein contact surfaces of the plug power supply electrodes (121) on the plugging bolt are of inclined surface structures, contact surfaces of the socket power supply electrodes (25) in the jack (211) are also of inclined surface structures, and the inclined surfaces of the plug power supply electrodes (121) are parallel to the inclined surfaces of the corresponding socket power supply electrodes (25).

10. The straight insertion self-locking anti-explosion electrical connection device according to claim 9, wherein a contact surface of the plug grounding electrode (111) on the plugging bolt is of an inclined surface structure, a contact surface of the socket grounding electrode (26) in the jack (211) is also of an inclined surface structure, and the inclined surface of the plug grounding electrode (111) is parallel to the inclined surface of the socket grounding electrode (26).

11. A socket, comprising a jack (211), wherein a wall of the jack (211) is provided with two or more socket power supply electrodes (25) and a socket grounding electrode (26), and is further provided with one or more socket self-locking portions (24); the socket self-locking portion (24) is used to achieve a self-locking effect together with a plug self-locking portion (112) on a plug, each socket self-locking portion (24) is provided with a clamping and locking member (243) having a convex or concave surface structure or a circular hole, and the clamping and locking member (243) matches with the plug self-locking portion (112) provided on the plug; and an orientation positioning pillar (221) is further provided in the jack (211), wherein contact surfaces of the plug power supply electrodes (121) on the plugging bolt are of inclined surface structures, and the inclined surfaces of the plug power supply electrodes (121) are parallel to inclined surfaces of corresponding power supply electrodes on the socket; a contact surface of the plug grounding electrode (111) on the plugging bolt is also of an inclined surface structure, and the inclined surface of the plug grounding electrode (111) is parallel to an inclined surface of a corresponding grounding electrode on the socket.

12. The socket according to claim 11, wherein a rib plate that firmly fits the plugging bolt is provided around the jack (211).

13. The socket according to claim 12, wherein two opposite socket self-locking portions (24) are disposed on the wall of the jack (211), and the curved surface structure of the clamping and locking member (243) is of a hemispherical shape.

14. The socket according to claim 12, wherein contact surfaces of the socket power supply electrodes (25) in the jack (211) are of inclined surface structures, and the inclined surfaces of the socket power supply electrodes (25) are parallel to inclined surfaces of corresponding power supply electrodes on the plug; a contact surface of the socket grounding electrode (26) in the jack (211) is also of an inclined surface structure, and the inclined surface of the socket grounding electrode (26) is parallel to an inclined surface of a corresponding grounding electrode on the plug.

* * * * *